US005956813A

United States Patent [19]

Cooper

[11] Patent Number: 5,956,813

[45] Date of Patent: Sep. 28, 1999

[54] CABLE TIE

[75] Inventor: William J. Cooper, Woonsocket, R.I.

[73] Assignee: Avery Dennison Corporation, Pasadena, Calif.

[21] Appl. No.: 09/095,479

[22] Filed: Jun. 10, 1998

[51] Int. Cl.[6] ..... B65D 63/00

[52] U.S. Cl. ..... 24/16 PB; 24/17 AP

[58] Field of Search ..... 24/17 AP, 17 R, 24/16 PB, 16 R, 30.5 R, 30.5 P; 248/74.3

[56] References Cited

U.S. PATENT DOCUMENTS

| | | | |
|---|---|---|---|
| 3,102,311 | 9/1963 | Martin et al. | 24/16 PB |
| 3,654,669 | 4/1972 | Fulton . | |
| 4,377,887 | 3/1983 | Valestin . | |
| 4,665,588 | 5/1987 | Nakano . | |
| 4,688,302 | 8/1987 | Caveney et al. . | |
| 4,882,813 | 11/1989 | Nakamura | 24/17 AP X |
| 5,117,575 | 6/1992 | Desmond . | |
| 5,224,244 | 7/1993 | Ikeda et al. . | |
| 5,293,668 | 3/1994 | Tibiletti . | |
| 5,377,387 | 1/1995 | Freed . | |
| 5,395,343 | 3/1995 | Iscovich . | |
| 5,443,155 | 8/1995 | Robinson . | |
| 5,537,719 | 7/1996 | Freed . | |
| 5,630,252 | 5/1997 | Wells . | |
| 5,636,412 | 6/1997 | Lodi et al. . | |
| 5,642,554 | 7/1997 | Sorensen et al. . | |
| 5,651,376 | 7/1997 | Thompson . | |
| 5,758,390 | 6/1998 | Villeneuve . | |

FOREIGN PATENT DOCUMENTS

| | | | |
|---|---|---|---|
| 0 759 532 | 2/1997 | European Pat. Off. | 24/16 PB |

*Primary Examiner*—Anthony Knight
*Assistant Examiner*—Robert J. Sandy
*Attorney, Agent, or Firm*—Kriegsman & Kriegsman

[57] ABSTRACT

A one piece cable tie for forming a plurality of objects such as cables into a bundle. The cable tie includes an elongated flexible strap having a first end, a second end, a top planar surface, a bottom planar surface, a first recessed portion formed in the top planar surface, a second recessed portion formed in the bottom planar surface, a first set of ratchet-shaped teeth formed within the first recessed portion and a second set of ratchet-shaped teeth formed within the second recessed portion. The cable tie further includes a locking head integrally formed to the first end of the strap. The locking head includes a top surface and a bottom surface. The locking head also includes an inner channel wall, an outer channel wall and a pair of sidewalls which together define a strap accepting channel therebetween, the strap accepting channel having a first open end formed in the top surface of the locking head and a second open end formed in the bottom surface of the locking head. A locking pawl is pivotally connected to the inner channel wall of the locking head and a projection is fixedly connected to each sidewall of the locking head. In use, the locking pawl lockably engages at least one tooth on the strap and abuts against the projections to prevent withdrawal of the strap from the locking head when the second end of the strap is inserted into the strap accepting channel in through the first open end or when the second end of the strap is inserted into the strap accepting channel in through the second open end.

9 Claims, 7 Drawing Sheets

CABLE TIE

BACKGROUND OF THE INVENTION

The present invention relates to cable ties.

Cable ties, also known as harnessing devices, are well known in the art and are commonly used to bundle a plurality of objects, such as cables. Cable ties typically comprise an elongated strip of material, such as plastic, having a head at one end, a tail at the other end and either teeth or rungs disposed along the length of the tail. Typically, the head of such cable ties comprise a strap accepting channel and a locking pawl which extends into the strap accepting channel, the locking pawl being pivotally disposed within the head of the cable tie about a thin, flexible hinge.

In use, cable ties typically function in the following manner to bundle a plurality of objects. Insertion of the tail of the tie into the strap accepting channel causes the locking pawl to pivot, thereby enabling the tail to be further advanced through the head until the cable tie takes the shape of a loop around the bundle of objects. Upon release of the insertion force, the pawl of the cable tie pivots back to its original position about the flexible hinge and lockably engages the tail in position around the bundle, the tail being incapable of removal once it is inserted in the head.

As an example of one type of cable tie, in U.S. Pat. No. 5,642,554 to S. C. Sorensen et al, there is disclosed a cable tie having an enhanced locking engagement between a pawl and ratchet teeth on a tongue. The cable tie includes an elongated tongue and a locking head having a movable pawl that is hinged at one side of an opening in the locking head across the opening from an abutment surface for locking engagement with a first set of ratchet teeth on one broad side of the tongue when the tip of the tongue has been inserted through the opening and teeth on the abutment surface for locking engagement with a second set of ratchet teeth on the other broad side of the tongue when the tip of the tongue has been inserted through the opening, and in which the side of the pawl including the pawl teeth converges toward the opposite side of the pawl in the direction of insertion, locking engagement is enhanced by the locking surface of at least one pawl tooth extending toward the apex of such tooth at an angle inclined toward the direction of insertion for locking engagement with a tooth of the first set of ratchet teeth; and by the locking surface of at least one of the first set of ratchet teeth extending toward the apex of such tooth at an angle inclined away from the direction of insertion for locking engagement with a pawl tooth.

As another example of another type of cable tie, in U.S. Pat. No. 4,688,302 to J. E. Caveney et al, there is disclosed an integral one-piece cable tie including an elongated flexible strap having a row of teeth thereon, a frame integral with one end of the strap and having an abutment wall and an entry surface and an exit surface and a strap-receiving opening extending therethrough, a pawl pivotally mounted by a hinge within the opening and having a set of teeth thereon shaped complementary to the row of teeth, wedging surfaces on the facing portions of the frame and the pawl, the thickness of the hinge being less than the thickness of the strap so as to accommodate sliding movement of the pawl toward the entry surface with the wedging surfaces in contact, thereby to move the set of teeth toward the abutment wall to grip the strap therebetween.

It should be noted that cable ties of the type described above often experience pawl failure. Specifically, in use, the lockable pawl engages at least one of the teeth or rungs on the strap of the cable tie and wedges the strap against an abutment surface which is across the strap accepting channel from the pawl. As a consequence of this particular design, it has been found that the entire load of the locking force of the pawl is displaced onto the relatively weak hinge of the pawl. As a result, the application of a significant withdrawal force tends to break the pawl hinge, thereby rendering the cable tie nonfunctional.

It should also be noted that pawl failure can not be remedied by strengthening the pawl hinge of the cable tie because the pawl hinge must be weak and flexible enough to permit the pawl to pivot during use.

SUMMARY OF THE INVENTION

It is an object of this invention to provide a new and improved cable tie.

It is another object of this invention to provide a one-piece cable tie.

It is yet another object of this invention to provide a cable tie as described above which provides for the secure bundling of a plurality of objects.

It is still another object of this invention to provide a cable tie as described above which has a minimum number of parts, is simple in construction and is easy to use.

Accordingly, there is provided a one piece cable tie for forming a plurality of objects such as cables into a bundle, said cable tie comprising an elongated flexible strap having a first end, a second end, a top surface, a bottom surface and a plurality of teeth disposed on opposite sides of said strap, and a locking head integrally formed to the first end of said strap, said locking head comprising a top surface and a bottom surface, said locking head further comprising an inner channel wall, an outer channel wall and a pair of sidewalls which together define a strap accepting channel therebetween, the strap accepting channel having a first open end formed in the top surface of said locking head and a second open end formed in the bottom surface of said locking head, said locking head further comprising a pawl which lockably engages one of the plurality of teeth to prevent withdrawal of said strap from said locking head, said pawl lockably engaging one of the plurality of teeth when the second end of said strap is inserted into the strap accepting channel in through the first open end or when the second end of said strap is inserted into the strap accepting channel in through the second open end.

Various other features and advantages will appear from the description to follow. In the description, reference is made to the accompanying drawings which form a part thereof, and in which is shown by way of illustration, a specific embodiment for practicing the invention. This embodiment will be described in sufficient detail to enable those skilled in the art to practice the invention, and it is to be understood that other embodiments may be utilized and that structural changes may be made without departing from the scope of the invention. The following detailed description is therefore, not to be taken in a limiting sense, and the scope of the present invention is best defined by the appended claims.

BRIEF DESCRIPTION OF THE DRAWINGS

In the drawings wherein like reference numerals represent like parts.

DETAILED DESCRIPTION OF THE PREFERRED EMBODIMENT

Figure 1:
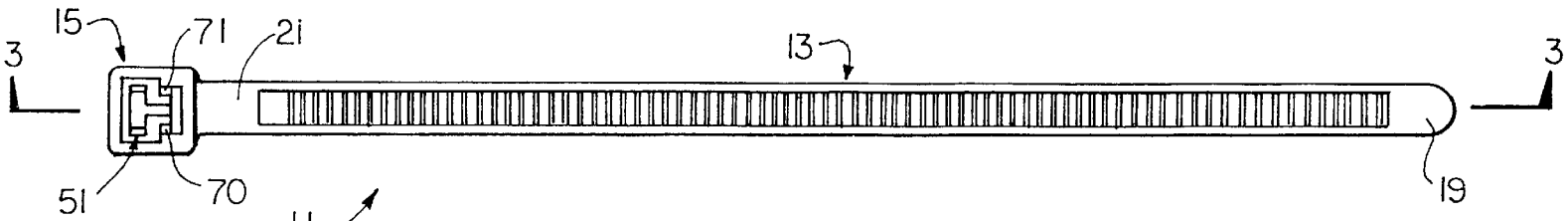
FIG. 1 is a top view of a cable tie constructed according to the teachings of the present invention.

Referring now to the drawings, there is shown a cable tie constructed according to the teachings of the present invention, the cable tie being identified by reference numeral 11. Cable tie 11 can be used to bundle together a plurality of cables C; however, it is to be understood that the invention is not exclusively limited to bundling cables, but rather may be used to bundle together other objects.

Cable tie 11 is a one piece tie comprising an elongated strap 13 and a locking head 15.

Figure 3:
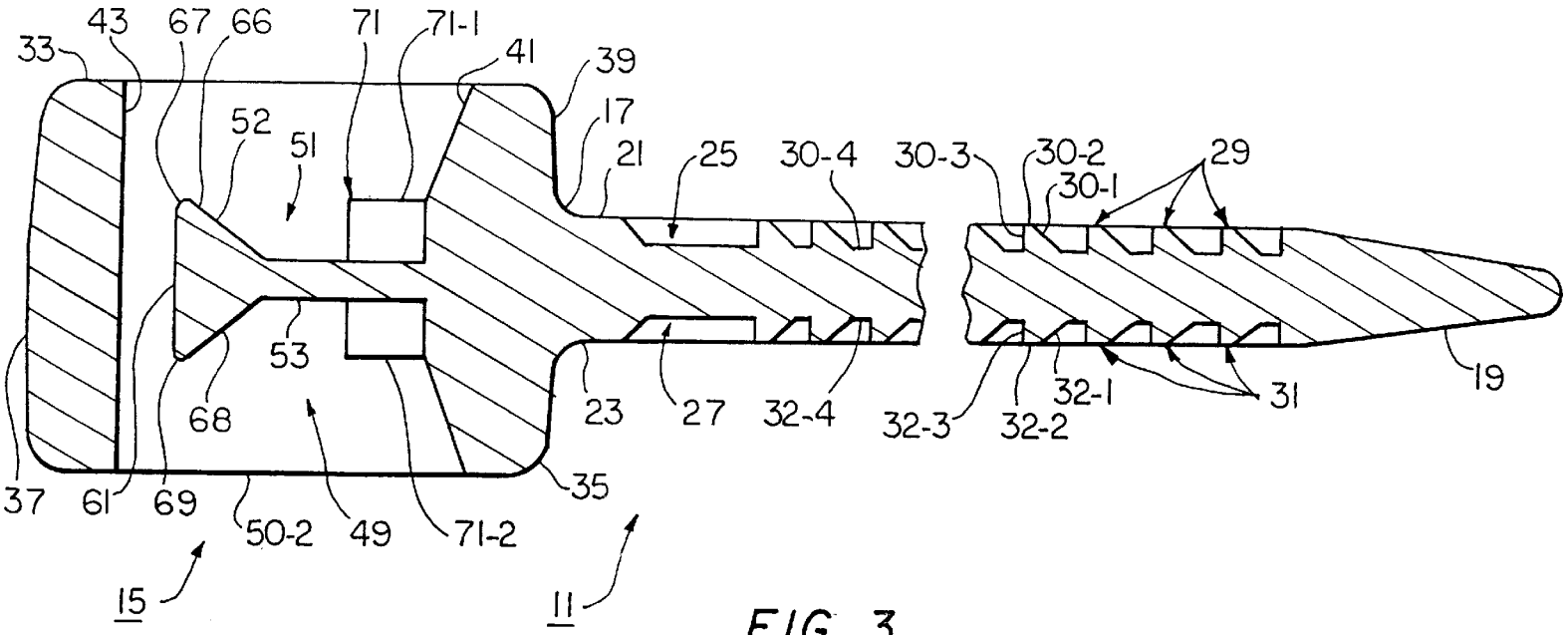
FIG. 3 is an enlarged, side, section view, broken away in part, of the cable tie shown in FIG. 1 taken along lines 3—3.

Elongated strap 13 is constructed of a flexible material such as plastic, nylon or a high modulus elastomer and includes a first end 17, a second end 19, a top planar surface 21 and a bottom planar surface 23. As shown in FIG. 3, the thickness of strap 13 tapers in slightly at second end 19 to enable strap 13 to be easily inserted into locking head 15.

Strap 13 further includes a first recessed portion 25 formed in top planar surface 21 and a second recessed portion 27 formed in bottom planar surface 23. A first set of ratchet shaped teeth 29 extend transversely along the length of first recessed portion 25 and a second set of ratchet shaped teeth 31, identical in size, shape and number with first set of ratchet shaped teeth 29, extend transversely along the length of second recessed portion 27.

It should be noted that second set of teeth 31 are formed within second recessed portion 27 in symmetrical relation to the manner in which first set of teeth 29 are formed within first recessed portion 25. As will be described in detail below, the symmetrical construction of strap 13 enables strap 13 to be fed into locking head 15 in either of two opposite directions.

Each of teeth 29 comprise an angled front wall 30-1, a flat top surface 30-2, a vertical rear wall 30-3 and a flat bottom surface 30-4. Flat top surface 30-2 of each of teeth 29 protrudes up to a point just beneath the level of top planar surface 21. Flat bottom surface 30-4 of each of teeth 29 is colinear with the deepest portion of first recessed portion 25.

Similarly, each of teeth 31 comprise an angled front wall 32-1, a flat top surface 32-2, a vertical rear wall 32-3 and a flat bottom surface 32-4. Flat top surface 32-2 of each of teeth 31 protrudes up to a point just beneath the level of bottom planar surface 23. Flat bottom surface 32-4 of each of teeth 31 is colinear with the deepest portion of second recessed portion 27.

Locking head 15 comprises a top surface 33, a bottom surface 35, an outer end wall 37 and an inner end wall 39. Inner end wall 39 of locking head 15 is integrally formed to first end 17 of elongated strap 13 to make cable tie 11 a unitary device.

Locking head 15 also comprises an inner channel wall 41, an outer channel wall 43, a first sidewall 45 and second sidewall 47 which together define a strap accepting channel 49 therebetween. As shown in FIG. 3, strap accepting channel 49 includes a first open end 50-1 formed in top surface 33 and a second open end 50-2 formed in bottom surface 35.

Locking head 15 further comprises a pawl 51 which is integrally connected to inner channel wall 41 of locking head 15 so as to form a unitary device, as shown in FIG. 3. Pawl 51 has a generally T-shaped configuration and comprises a pawl head 52 which is pivotally connected to inner channel wall 41 by a thin, flexible hinge 53. The size and shape of thin, flexible hinge 53 enables pawl head 52 to be pivoted in either of two opposite directions, namely, up towards first open end 50-1 or down towards second open end 50-2, as will be discussed further in detail below.

Figure 4A:
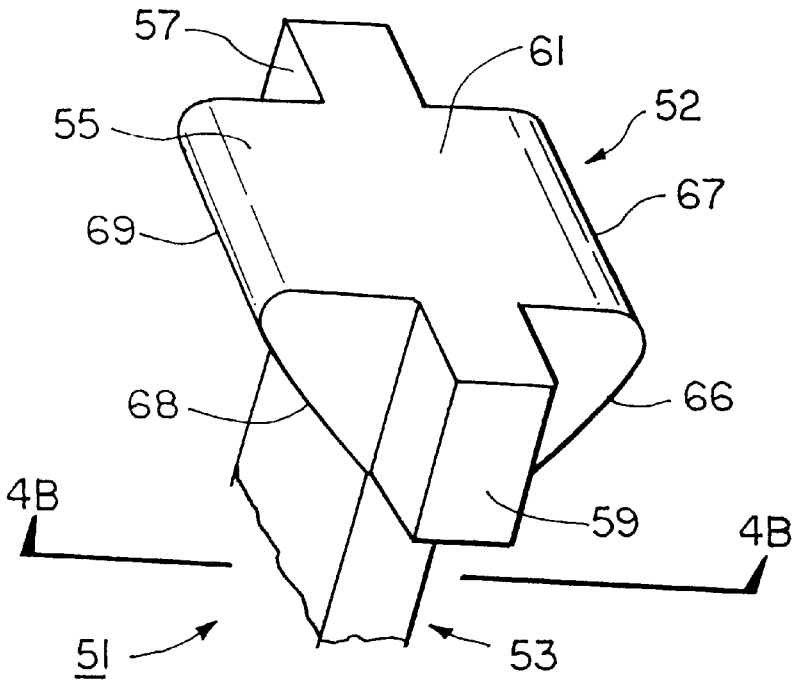
FIG. 4A is an enlarged, left end perspective view, broken away in part, of the locking pawl in the cable tie shown in FIG. 3.
Figure 4B:
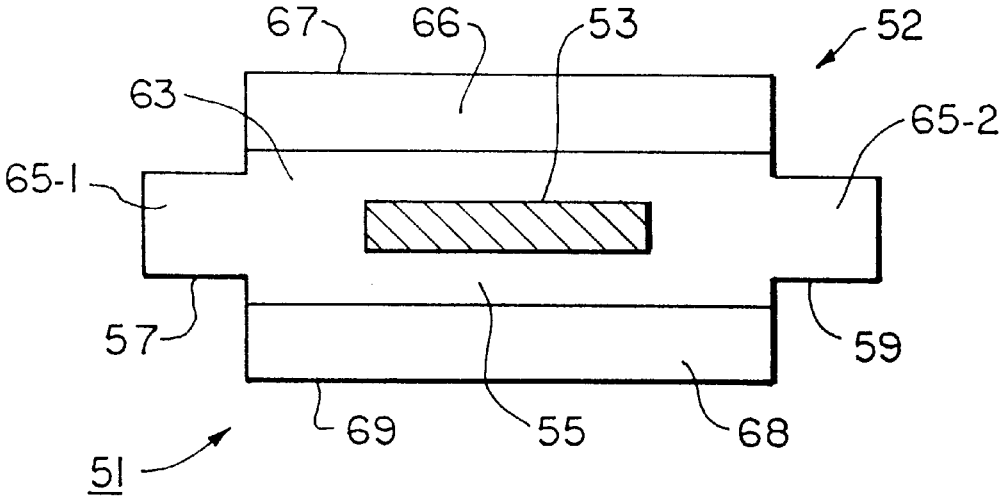
FIG. 4B is an enlarged, bottom section view of the locking pawl shown in FIG. 4A taken along lines 4B—4B.

Pawl head 52 of locking pawl 51 comprises a generally triangularly-shaped, central section 55 and first and second rectangularly-shaped end sections 57 and 59 which are integrally formed onto opposite ends of central section 55 to make pawl head 52 a unitary device. As shown in FIGS. 3 and 4A, central section 55 and first and second end sections 57 and 59 together comprise a common, flat, outer end wall 61. Similarly, as shown in FIG. 4B, central section 55 and first and second end sections 57 and 59 together comprise a common, flat, inner end wall 63. Flat inner end wall 63 includes a first rectangularly-shaped abutment portion 65-1 at first end section 57 and a second rectangularly-shaped abutment portion 65-2 at second end section 59.

Triangularly-shaped, central section 55 comprises an angled top surface 66 and an angled bottom surface 68, flat end wall 61 adjoining angled top surface 66 to form an elongated, top corner 67 and flat end wall 61 adjoining angled bottom surface 68 to form an elongated, bottom corner 69. Both angled top surface 66 and angled bottom surface 68 have a width which is slightly less than the width of first and second recessed portions 25 and 27 and both angled top surface 66 and angled bottom surface 68 have a thickness which is slightly less than the depth of first and second recessed portions 25 and 27.

Figure 2A:
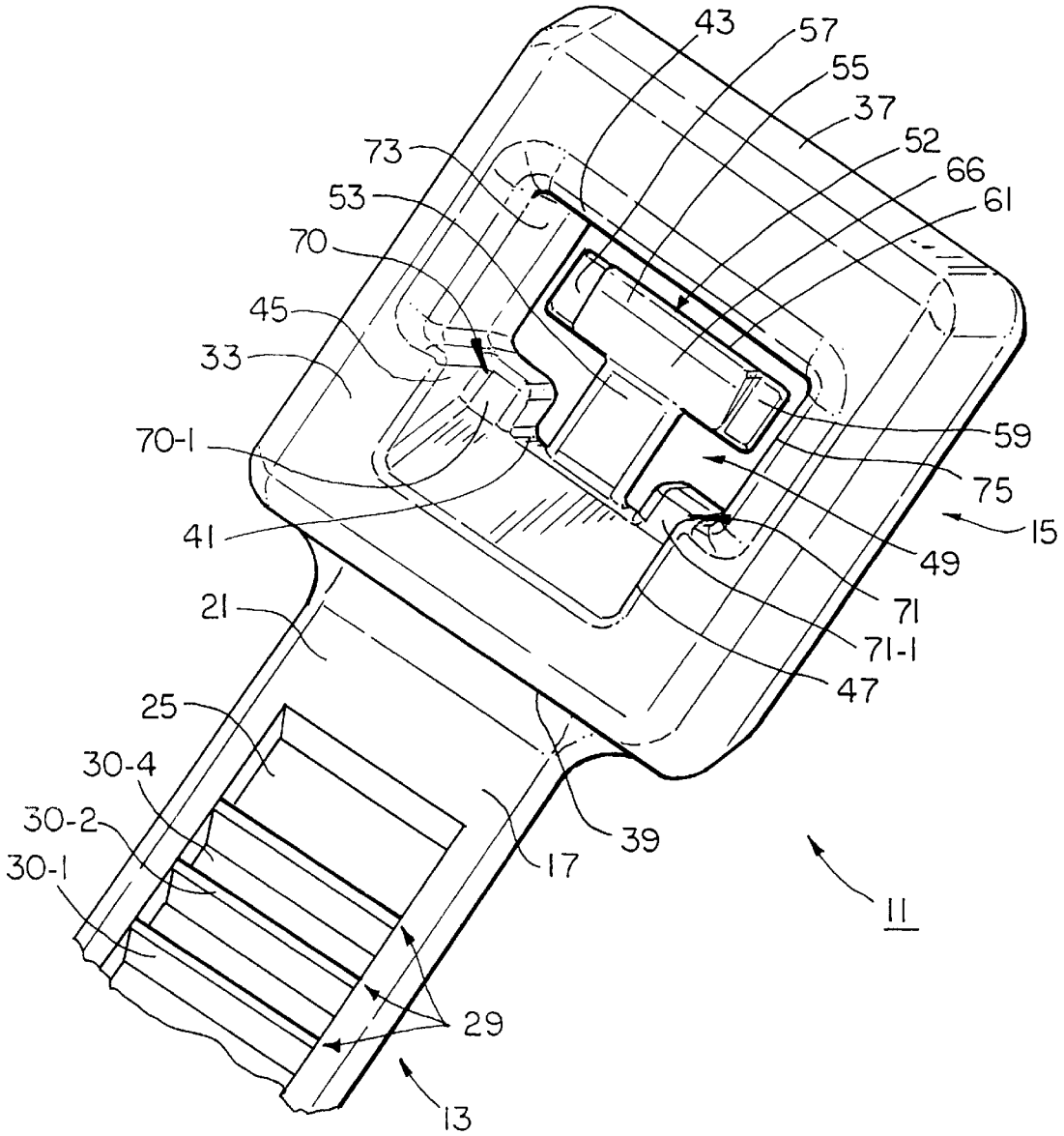
FIG. 2A is an enlarged, top perspective view, broken away in part, of the cable tie shown in FIG. 1.
Figure 2B:
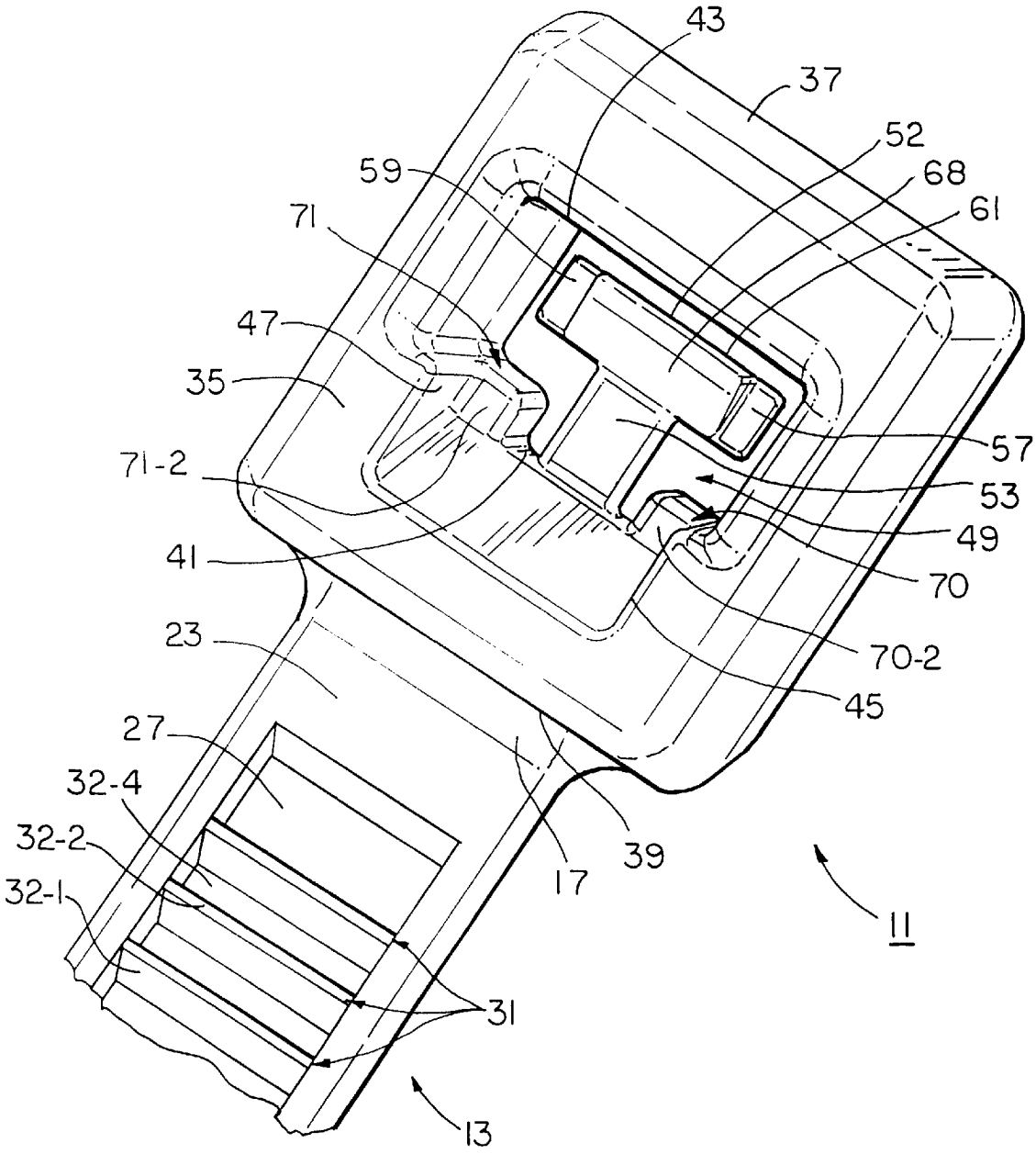
FIG. 2B is an enlarged, bottom perspective view, broken away in part, of the cable tie shown in FIG. 1.

Locking head 15 additionally comprises a first rectangularly shaped projection 70 which is integrally formed onto first sidewall 45 so as to extend into strap accepting channel 49 and a second rectangularly shaped projection 71 which is integrally formed onto second sidewall 47 so as to extend into strap accepting channel 49, second projection 71 being identical in size and shape as first projection 70. As shown in FIG. 2A, first rectangularly shaped projection 70 comprises a flat, top abutment surface 70-1 and second rectangularly shaped projection 71 comprises a flat, top abutment surface 71-1. Similarly, as shown in FIG. 2B, first rectangularly shaped projection 70 comprises a flat, bottom abutment surface 70-2 and second rectangularly shaped projection 71 comprises a flat, bottom abutment surface 71-2.

As will be discussed in further detail below, pawl 51 serves to wedge strap 13 against outer channel wall 43 to preclude removal of strap 13 from locking head 15 regardless of whether strap 13 is fed into strap accepting channel 49 through first open end 50-1 or whether strap 13 is fed into strap accepting channel 49 through second open end 50-2.

First sidewall 45 and second sidewall 47 are each shaped to include a recessed guide slot 73 and 75, respectively. Recessed guide slots 73 and 75 serve to facilitate the insertion of the free end of tail 13 into locking head 15.

Tie 11 may be used to secure a plurality of cables C as a bundle in the following manner. Second end 19 of strap 13 is wrapped around cables C and is inserted through strap accepting channel 49 to form a loop. As noted above, second end 19 of strap 13 can be inserted into strap accepting channel 49 in either of two opposing directions, namely in a first direction as represented by arrow A in FIG. 4 or in a second direction as represented by arrow B in FIG. 5.

Figure 6:
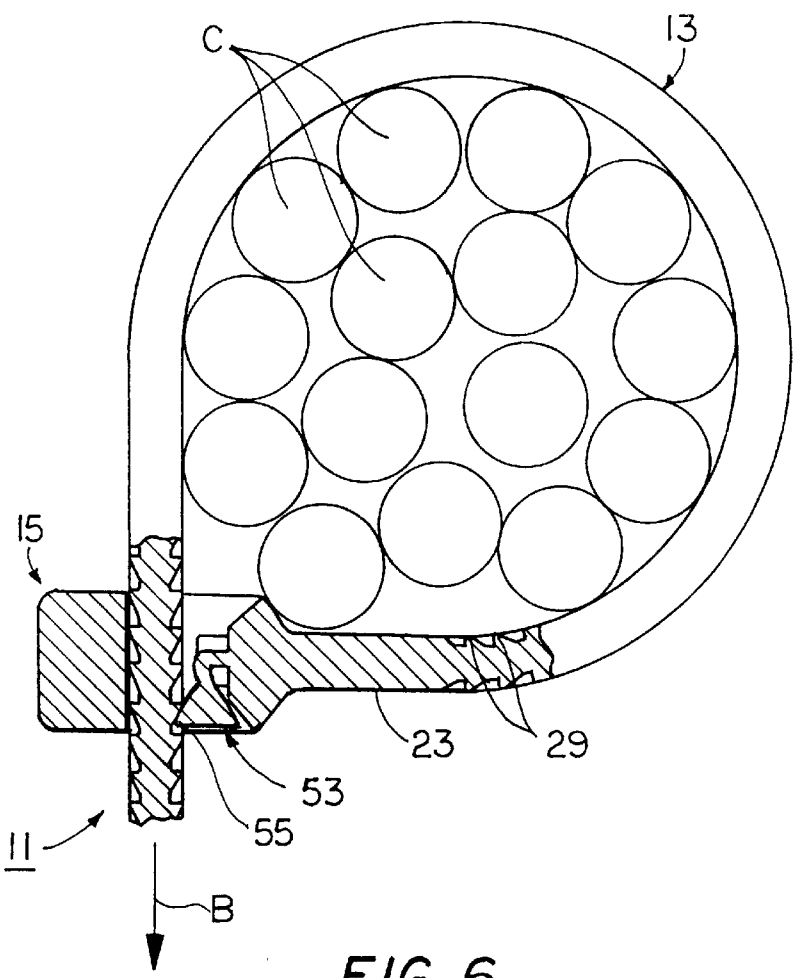
FIG. 6 is a side view of the cable tie shown in FIG. 1, the tail of the cable tie being shown inserted into the locking head in a second direction to form a loop around a plurality of cables, the cable tie being shown partially in section and broken away in part.

Second end 19 of strap 13 can be inserted into strap accepting channel 49 in the first direction, as represented by arrow A in FIG. 4, to wrap cable tie 11 around the plurality of cables C. Specifically, second end 19 is first inserted into strap accepting channel 49 through second open end 50-2, in the direction shown by arrow A in FIG. 6, the insertion of second end 19 causing bottom planar surface 23 of strap 13 to pivot pawl head 52 about hinge 53 and in the direction up towards first open end 50-1. With pawl head 52 of pawl 51 pivoted up in the direction towards first open end 50-1, the ratchet shape of teeth 31 enables second end 19 of strap 13 to be further advanced into strap accepting channel 49 and out through first open end 50-1 to reduce the size of the loop, thereby drawing tie 11 tight around the bundle of cables C.

Figure 8:
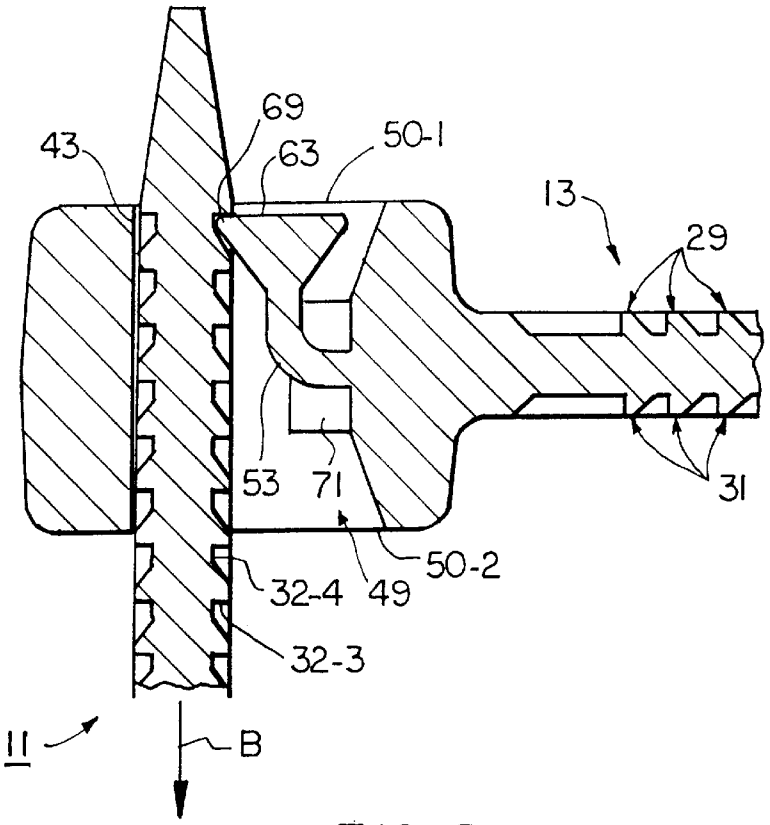
FIG. 8 is an enlarged, side, section view, broken away in part, of another step in the insertion of the tail of the cable tie of FIG. 5 into the locking head in the first direction, the cable tie being shown without the plurality of cables.
Figure 7:
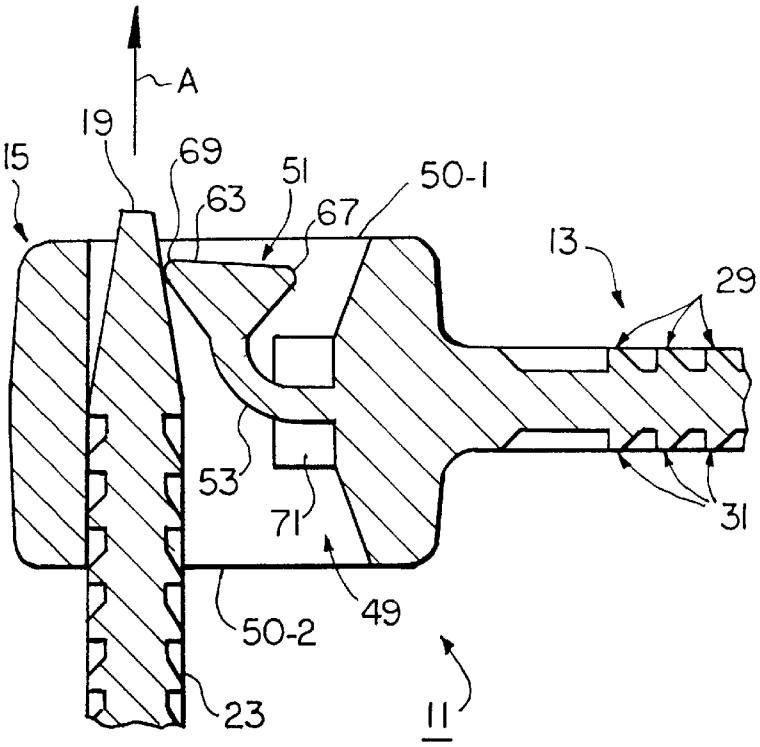
FIG. 7 is an enlarged, side, section view, broken away in part, of one step in the insertion of the tail of cable tie of FIG. 5 into the locking head in the first direction, the cable tie being shown without the plurality of cables.
Figure 9:
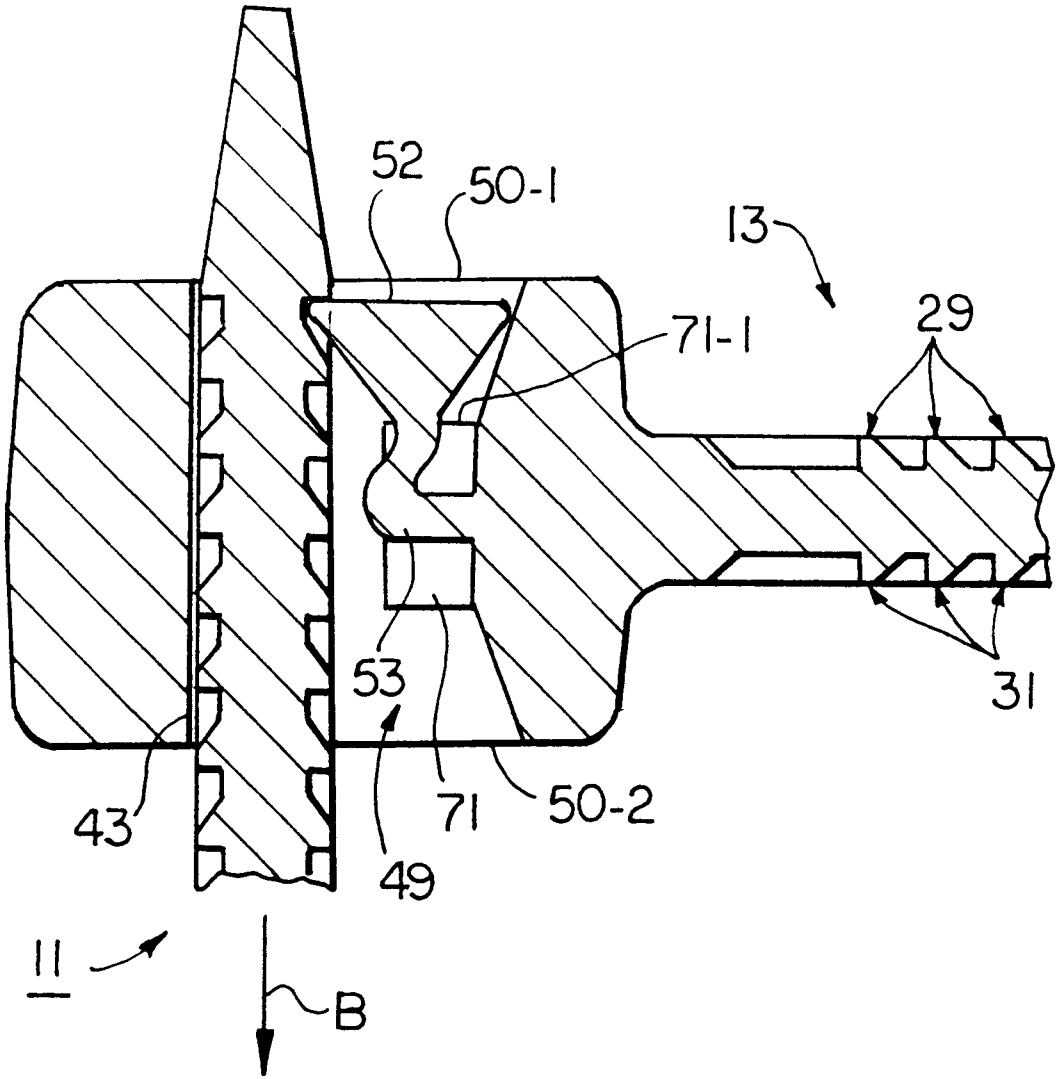
FIG. 9 is an enlarged, side, section view, broken away in part, of another step in the insertion of the tail of the cable tie of FIG. 5 into the locking head in the first direction, the cable tie being shown without the plurality of cables.

Movement of strap 13 in the direction towards second open end 50-2, in the direction shown by arrow B in FIG. 7, causes elongated bottom corner 69 of pawl head 52 to engage one of teeth 31 at the juncture of vertical rear wall 32-3 and flat bottom surface 32-4 which, in turn, causes pawl head 52 to pivot about hinge 53 and in the direction back down towards second open end 50-2. Pivoting of pawl head 52 back down towards second open end 50-2 causes pawl head 52 to urge strap 13 towards outer channel wall 43 until strap 13 is effectively wedged against outer channel wall 43. As strap 13 continues to move down towards second open end 50-2, in the direction shown by arrow B in FIG. 8, hinge 53 buckles such that first and second rectangularly-shaped abutment portions 65-1 and 65-2 of pawl head 52 contact flat, top abutment surfaces 70-1 and 71-1, respectively.

It should be noted that the abutment of first and second rectangularly-shaped abutment portions 65-1 and 65-2 of pawl head 52 against projections 70 and 71, respectively, serves to increase the overall strength of cable tie 11. Specifically, the abutment of pawl head 52 against projections 70 and 71 serves to transfer the majority of the load strength in locking cable tie 11 around a bundle from thin, flexible hinge 53, which is inherently weak in construction, and onto the enlarged pawl head 52, which is inherently strong in construction in comparison to hinge 53.

Figure 5:
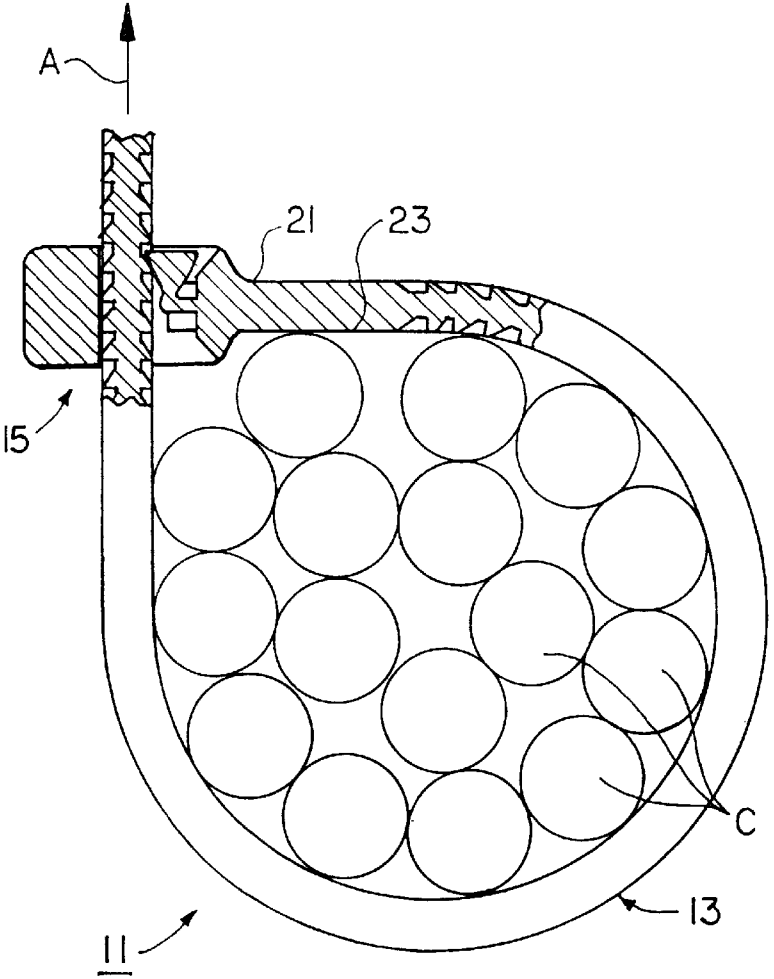
FIG. 5 is a side view of the cable tie shown in FIG. 1, the tail of the cable tie being show inserted into the locking head in a first direction to form a loop around a plurality of cables, the cable tie being shown partially in section and broken away in part.

As noted above, second end 19 of strap 13 can also be inserted into strap accepting channel 49 in a second direction, as represented by arrow B in FIG. 5, to wrap cable tie 11 around the plurality of cables C. Due the symmetrical construction of cable tie 11, cable tie 11 functions in a similar manner when second end 19 of strap 13 is inserted into strap accepting channel 49 in the first direction as when second end 19 of strap 13 is inserted into strap accepting channel 49 in the second direction. Specifically, when second end 19 of strap 13 is inserted into strap accepting channel 49 in the second direction, elongated top corner 67 of pawl head 52 engages one of teeth 29 at the juncture of vertical rear wall 30-3 and flat bottom surface 30-4 which, in turn, causes pawl head 52 to pivot about hinge 53 and in the direction towards first open end 50-1. Pivoting of pawl head 52 towards first open end 50-1 causes pawl head 52 to urge strap 13 towards outer channel wall 43 until strap 13 is effectively wedged against outer channel wall 43. As strap 13 continues to move up towards first open end 50-1, hinge 53 buckles such that rectangularly-shaped, abutment portions 65-1 and 65-2 of pawl head 52 abut against flat, bottom abutment surfaces 70-2 and 71-2, respectively.

The embodiment shown in the present invention is intended to be merely exemplary and those skilled in the art shall be able to make numerous variations and modifications to it without departing from the spirit of the present invention. For example, it is to be understood that angled surfaces 66 and 68 could include gripping teeth without departing from the spirit of the present invention. Furthermore, although cable tie 11 is shown as being a unitary structure, it is to be understood that tie 11 could be manufactured as a non-unitary structure without departing from the spirit of the present invention. All such variations and modifications are intended to be within the scope of the present invention as defined in the appended claims.

What is claimed is:

1. A one piece cable tie for forming a plurality of objects such as cables into a bundle, said cable tie comprising:

(a). an elongated flexible strap having a first end, a second end, a top surface, a bottom surface and a plurality of teeth disposed on opposite sides of said strap, and (b). a locking head integrally formed to the first end of said strap, said locking head comprising a top surface and a bottom surface, said locking head further comprising an inner channel wall, an outer channel wall and a pair of sidewalls which together define a strap accepting channel therebetween, the strap accepting channel having a first open end formed in the top surface of said locking head and a second open end formed in the bottom surface of said locking head, said locking head further comprising a pawl which lockably engages one of the plurality of teeth to prevent withdrawal of said strap from said locking head, said pawl comprising an enlarged pawl head which is pivotally connected to the inner channel wall of said locking head about a thin, flexible hinge so as to enable said pawl head to pivot in either the direction towards the first open end or in the direction towards the second open end, said pawl being sized and shaped to lockably engage one of the plurality of teeth and wedge said strap against the outer channel wall of said locking head when the second end of said strap is inserted into the strap accepting channel in through the first open end and when the second end of said strap is inserted into the strap accepting channel in through the second open end, (c). wherein said locking head further comprises a fixed projection, said fixed projection being positioned within the locking head and spaced from the hinge of said pawl so that the pawl head of said pawl abuts against said projection to further prevent withdrawal of said strap from said locking head when said pawl lockably engages one of the plurality of teeth on either side of the elongated flexible strap.

2. A one piece cable tie for forming a plurality of objects such as cables into a bundle, said cable tie comprising:

(a). an elongated flexible strap having a first end, a second end, a top surface, a bottom surface and a plurality of teeth disposed on opposite sides of said strap, and (b). a locking head integrally formed to the first end of said strap, said locking head comprising a top surface and a bottom surface, said locking head further comprising an inner channel wall, an outer channel wall and a pair of sidewalls which together define a strap accepting channel therebetween, the strap accepting channel having a first open end formed in the top surface of said locking head and a second open end formed in the bottom surface of said locking head, said locking head further comprising a pawl which lockably engages one of the plurality of teeth to event withdrawal of said strap from said locking head, said pawl comprising an enlarged pawl head which is pivotally connected to the inner channel wail of said locking head about a thin, flexible hinge so as to enable said pawl head to pivot in either the direction towards the first open end or in the direction towards the second open end, said pawl being sized and shaped to lockably engage one of the plurality of teeth and wedge said strap against the outer channel wall of said locking head when the second end of said strap is inserted into the strap accepting channel in through the first open end and when the second end of said strap is inserted into the strap accepting channel in through the second open end, (c). wherein said locking head further comprises a fixed projection, said fixed projection being integrally formed onto one of the pair of sidewalls so that the pawl head of said pawl abuts against said projection to further prevent withdrawal of said strap from said locking head when said pawl lockably engages one of the plurality of teeth.

3. A one piece cable tie for forming a plurality of objects such as cables into a bundle, said cable tie comprising:

(a). an elongated flexible strap having a first end, a second end, a top surface, a bottom surface and a plurality of teeth disposed on opposite sides of said strap, and (b). a locking head integrally formed to the first end of said strap, said locking head comprising a top surface and a bottom surface, said locking head further comprising an inner channel wall, an outer channel wall and a pair of sidewalls which together define a strap accepting channel therebetween, the strap accepting channel having a first open end formed in the top surface of said locking head and a second open end formed in the bottom surface of said locking head, said locking head further comprising a pawl which lockably engages one of the plurality of teeth to prevent withdrawal of said strap from said locking head, said pawl comprising an enlarged pawl head which is pivotally connected to the inner channel wall of said locking head about a thin, flexible hinge so as to enable said pawl head to pivot in either the direction towards the first open end or in the direction towards the second open end, said pawl being sized and shaped to lockably engage one of the plurality of teeth and wedge said strap against the outer channel wall of said locking head when the second end of said strap is inserted into the strap accepting channel in through the first open end and when the second end of said strap is inserted into the strap accepting channel in through the second open end, (c). wherein said locking head further comprises a pair of fixed projections, one projection being integrally formed onto each of the pair of sidewalls so that the pawl head of said pawl abuts against said pair of projections to further prevent withdrawal of said strap from said locking head when said pawl lockably engages one of the plurality of teeth.

4. The cable tie as claimed in claim 3 wherein said pawl head comprises a triangularly-shaped central section and first and second rectangularly-shaped end sections which are integrally formed onto opposite ends of the central section.

5. The cable tie as claimed in claim 4 wherein said cable tie is symmetrical in construction.

6. The cable tie as claimed in claim 5 wherein the plurality of teeth are ratchet shaped.

7. The cable tie as claimed in claim 6 wherein said strap further comprises a first recessed portion formed in the top surface and a second recessed portion formed in the bottom surface.

8. The cable tie as claimed in claim 7 wherein the plurality of teeth comprises a first set of teeth which are formed within the first recessed portion of said strap and a second set of teeth which are formed within the second recessed portion of said strap.

9. The cable tie as claimed in claim 8 wherein the first set of teeth extend transversely along the length of the first recessed portion and the second set of teeth extend transversely along the length of the second recessed portion.

* * * * *